US008202054B2

(12) United States Patent
Liang

(10) Patent No.: US 8,202,054 B2
(45) Date of Patent: Jun. 19, 2012

(54) BLADE FOR A GAS TURBINE ENGINE

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 819 days.

(21) Appl. No.: 11/804,426

(22) Filed: May 18, 2007

(65) Prior Publication Data

US 2008/0286115 A1 Nov. 20, 2008

(51) Int. Cl.
*F01D 5/18* (2006.01)

(52) U.S. Cl. ..... 416/97 R

(58) Field of Classification Search ..... 415/115; 416/96 R, 97 R, 97 A
See application file for complete search history.

(56) References Cited

U.S. PATENT DOCUMENTS 3,533,712 A * 10/1970 Kercher ..... 416/92
4,257,737 A * 3/1981 Andress et al. ..... 416/97 R
4,474,532 A * 10/1984 Pazder ..... 416/97 R
4,752,186 A * 6/1988 Liang ..... 416/97 R
5,387,085 A * 2/1995 Thomas et al. ..... 416/97 R
5,464,322 A * 11/1995 Cunha et al. ..... 415/115
5,702,232 A 12/1997 Moore
5,716,192 A * 2/1998 Phillips et al. ..... 416/97 R
5,720,431 A 2/1998 Sellers et al.
5,902,093 A * 5/1999 Liotta et al. ..... 416/97 R
5,931,638 A 8/1999 Krause et al.
6,139,269 A * 10/2000 Liang ..... 416/97 R
6,347,923 B1 2/2002 Semmler et al.
6,607,356 B2 * 8/2003 Manning et al. ..... 416/97 R
6,902,372 B2 6/2005 Liang
6,932,573 B2 8/2005 Liang
6,981,846 B2 1/2006 Liang
7,296,973 B2 * 11/2007 Lee et al. ..... 416/97 R
2005/0281674 A1 * 12/2005 Liang ..... 416/97 R
2006/0056967 A1 3/2006 Liang
2006/0222494 A1 10/2006 Liang

OTHER PUBLICATIONS

George Liang, Turbine Blade Having a Convergent Cavity Cooling System for a Trailing Edge, U.S. patent application and figures 1-5, filed with the USPTO on Feb. 15, 2007, U.S. Appl. No. 11/707,226.

* cited by examiner

*Primary Examiner* — Edward Look
*Assistant Examiner* — Jesse Prager

(57) ABSTRACT

A main body is provided for a gas turbine engine comprising an outer structure, a first internal partition and a second internal partition. The outer structure and the first internal partition may define an entrance leg of a cooling circuit for receiving a cooling fluid. The second internal partition may include a metering slot. The outer structure, the first internal partition and the second internal partition may define an intermediate leg of the cooling circuit. The intermediate leg may communicate with the entrance leg. The second internal partition and the outer structure may define an exit leg of the cooling circuit. The metering slot meters cooling fluid as it passes from the intermediate leg into the exit leg.

20 Claims, 4 Drawing Sheets

BLADE FOR A GAS TURBINE ENGINE

FIELD OF THE INVENTION

The present invention relates to a blade for a turbine of a gas turbine engine and, more preferably, to a blade having an improved cooling system.

BACKGROUND OF THE INVENTION

A conventional combustible gas turbine engine includes a compressor, a combustor, and a turbine. The compressor compresses ambient air. The combustor combines the compressed air with a fuel and ignites the mixture creating combustion products defining a working gas. The working gases travel to the turbine. Within the turbine are a series of rows of stationary vanes and rotating blades. Each pair of rows of vanes and blades is called a stage. Typically, there are four stages in a turbine. The rotating blades are coupled to a shaft and disc assembly. As the working gases expand through the turbine, the working gases cause the blades, and therefore the shaft and disc assembly, to rotate.

Combustors often operate at high temperatures that may exceed 2,500 degrees Fahrenheit. Typical combustor configurations expose turbine vanes and blades to these high temperatures. As a result, turbine vanes and blades must be made of materials capable of withstanding such high temperatures. In addition, turbine vanes and blades often contain cooling systems for prolonging the life of the vanes and blades and reducing the likelihood of failure as a result of excessive temperatures.

Conventional turbine blades have many different designs of internal cooling systems. While many of these conventional systems have operated successfully, the cooling demands of turbine engines produced today have increased. Thus, an internal cooling system for turbine blades as well as vanes having increased cooling capabilities is needed.

SUMMARY OF THE INVENTION

In accordance with a first aspect of the present invention, a blade is provided for a gas turbine engine. The blade comprises a main body comprising an outer structure and first and second internal partitions. The outer structure and the first internal partition define an entrance leg of a cooling circuit for receiving a cooling fluid. The second internal partition includes a metering slot. The outer structure, the first internal partition and the second internal partition define an intermediate leg of the cooling circuit. The intermediate leg communicates with the entrance leg. The second internal partition and the outer structure define an exit leg of the cooling circuit. The metering slot meters cooling fluid as it passes from the intermediate leg into the exit leg.

The outer structure may define at least portions of an attachment, a platform and an airfoil. The airfoil comprises a root section, a tip, a leading edge, a trailing edge, a pressure side and a suction side.

The outer structure may comprise an airfoil outer wall, the airfoil tip and an intermediate wall. The airfoil outer wall defines the root section, the leading edge, the trailing edge, the pressure side and the suction side of the airfoil. The intermediate wall extends from the airfoil root section to the airfoil tip and defines with a leading edge section of the airfoil outer wall an impingement cavity. The intermediate wall may include a plurality of bores through which cooling fluid passes under pressure from the entrance leg of the cooling circuit into the impingement cavity so as to impinge upon an inner surface of the leading edge section of the outer wall.

The leading edge section of the airfoil outer wall may comprise a plurality of bores which extend from the inner surface of the leading edge section to an outer surface of the leading edge section. The bores in the leading edge section communicate with the impingement cavity.

The first internal partition may extend from a lower surface of the attachment, through the attachment and the platform, into and through a substantial length of the airfoil outer wall and terminate near the airfoil tip.

The second internal partition may extend from the airfoil tip, through the airfoil outer wall, the platform and the attachment and may terminate at the attachment lower surface.

A trailing edge section of the airfoil outer wall may comprise a plurality of bores which extend from an inner surface of the trailing edge section to an outer surface of the trailing edge section.

A first rib plate may be provided extending from near the root section of the airfoil to near the airfoil tip and further extending between the suction and pressure sides of the airfoil. The first rib plate may include a plurality of bores extending therethrough.

A second rib plate may also be provided extending from near the root section of the airfoil to near the airfoil tip and further extending between the suction and pressure sides of the airfoil. The second rib plate may include a plurality of bores extending therethrough, wherein cooling fluid passing through the bores in the first rib plate impinge upon the second rib plate.

A plurality of the bores in the second rib plate may be offset relative to the bores in the first rib plate.

In accordance with a second aspect of the present invention, a blade is provided for a gas turbine engine comprising a main body comprising an outer structure and first and second internal partitions. The outer structure and the first internal partition may define an entrance leg of a cooling circuit for receiving a cooling fluid. The second internal partition may include a metering slot. The outer structure, the first internal partition and the second internal partition may define an intermediate leg of the cooling circuit. The second internal partition and the outer structure may define an exit leg of the cooling circuit. The metering slot may define a mechanism for causing a pressure of the cooling fluid in the entrance and intermediate, legs to be greater than a pressure of the cooling fluid in the exit leg.

In accordance with a third aspect of the present invention, a main body is provided for a gas turbine engine comprising an outer structure, a first internal partition and a second internal partition. The outer structure and the first internal partition may define an entrance leg of a cooling circuit for receiving a cooling fluid. The second internal partition may include a metering slot. The outer structure, the first internal partition and the second internal partition may define an intermediate leg of the cooling circuit. The intermediate leg may communicate with the entrance leg. The second internal partition and the outer structure may define an exit leg of the cooling circuit. The metering slot meters cooling fluid as it passes from the intermediate leg into the exit leg.

The outer structure may define at least portions of an airfoil comprising a leading edge, a trailing edge, a pressure side and a suction side. The outer structure may also define at least portions of inner and outer endwalls with the airfoil extending between the inner and outer endwalls. The airfoil and inner and outer endwalls may define a vane for a gas turbine engine.

DETAILED DESCRIPTION OF THE INVENTION

In the following detailed description of the preferred embodiment, reference is made to the accompanying drawings that form a part hereof, and which is shown by way of illustration, and not by way of limitation, a specific preferred embodiment in which the invention may be utilized and that changes may be made without departing from the spirit and scope of the present invention.

Figure 1:
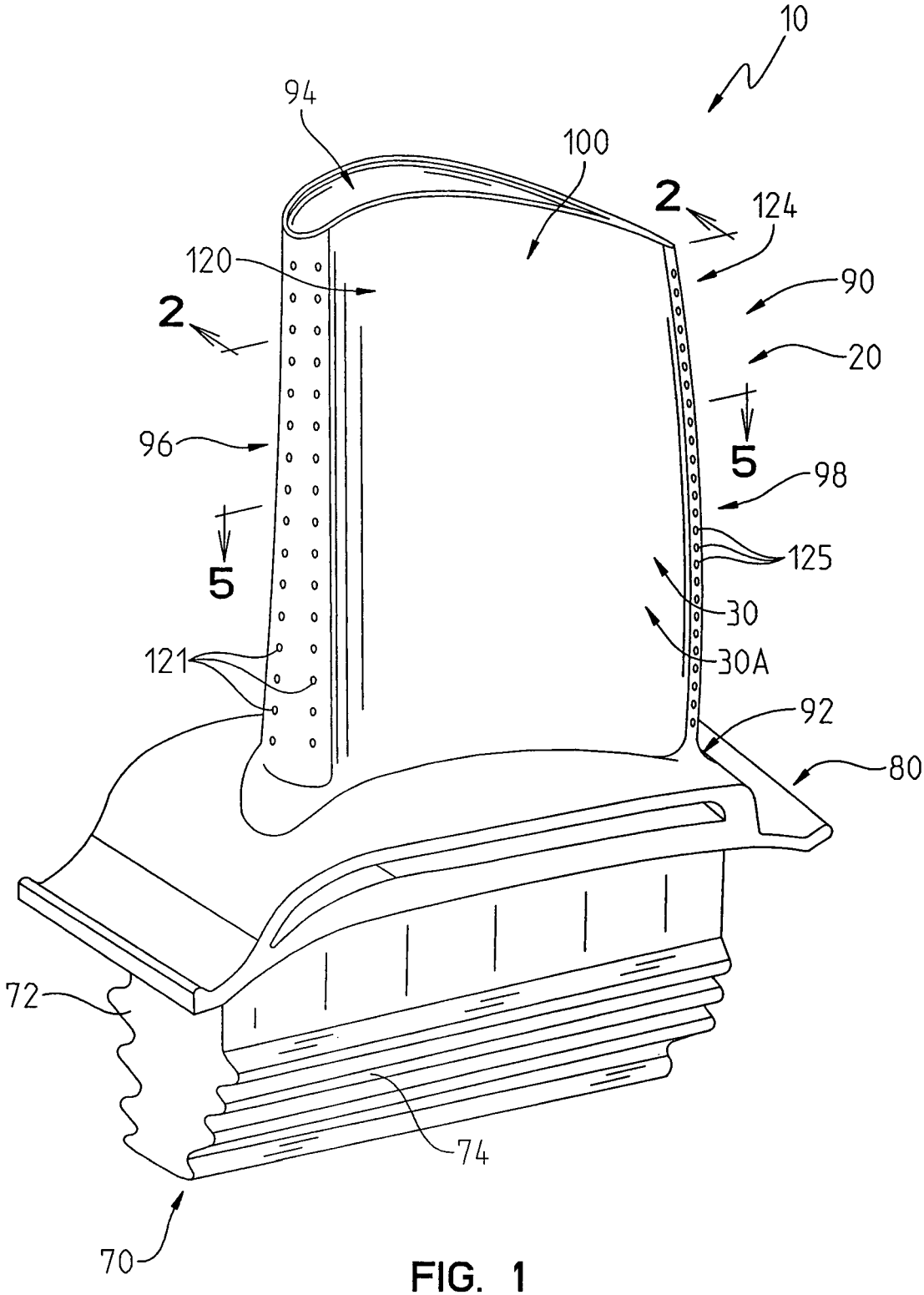
FIG. 1 is a perspective view of a blade constructed in accordance with the present invention.

Referring now to FIG. 1, a blade 10 constructed in accordance with the present invention is illustrated. The blade 10 is adapted to be used in a gas turbine (not shown) of a gas turbine engine (not shown). Within the gas turbine are a series of rows of stationary vanes and rotating blades. Typically, there are four rows of blades in a gas turbine. It is contemplated that the blade 10 illustrated in FIG. 1 may define the blade configuration for a second row of blades in the gas turbine.

The blades are coupled to a shaft and disc assembly. Hot working gases from a combustor (not shown) in the gas turbine engine travel to the rows of blades. As the working gases expand through the turbine, the working gases cause the blades, and therefore the shaft and disc assembly, to rotate.

The blade 10 comprises a main body 20 comprising an outer structure 30 and first and second internal partitions 40 and 50, respectively. The outer structure 30 and the first internal partition 40 define an entrance leg 60 of a cooling circuit 600 for receiving a cooling fluid. A cooling fluid, such as air or steam, is supplied under pressure in the direction of arrow A in FIG. 2 to an initial portion 60A of the entrance leg 60 of the cooling circuit 600. The cooling fluid may be supplied by the compressor (not shown) of the gas turbine engine via conventional supply structure (not shown) extending to the entrance leg initial portion 60A.

Figure 2:
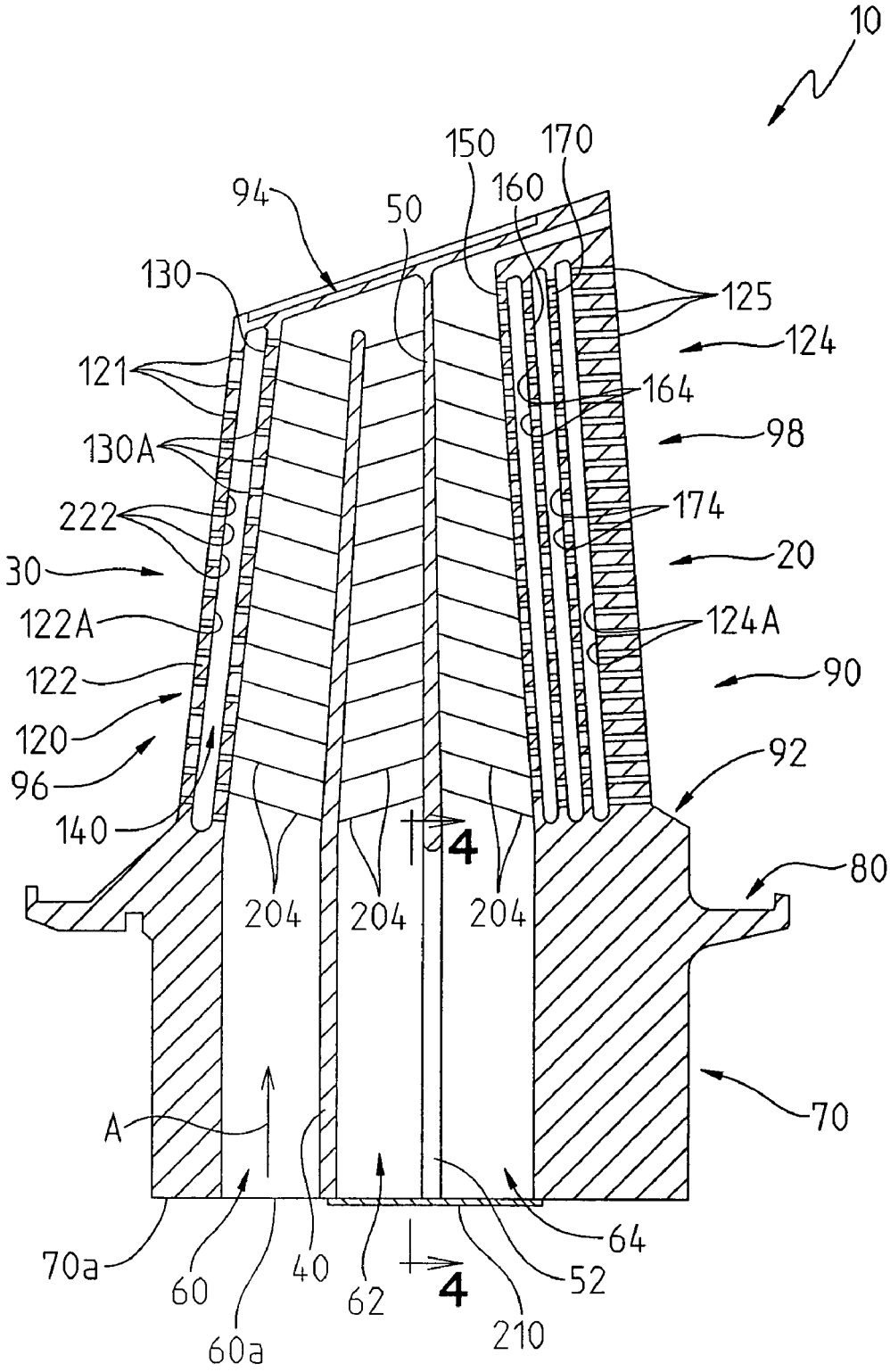
FIG. 2 is a view taken along section line 2-2 in FIG. 1.
Figure 4:
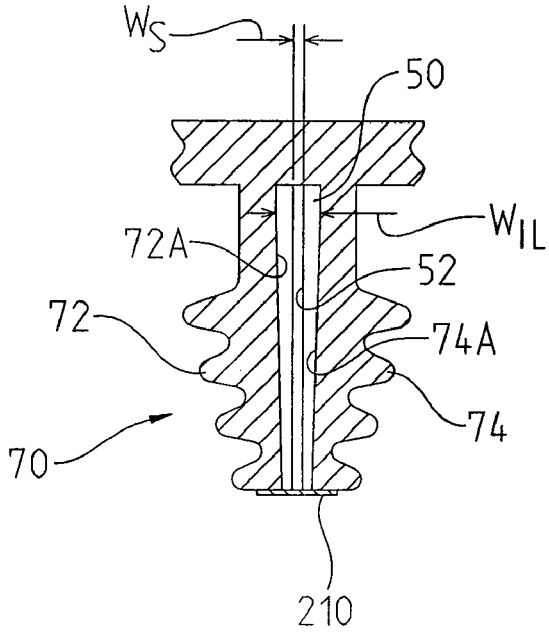
FIG. 4 is a cross sectional view taken along section line 4-4 in FIG. 2.

The second internal partition 50 includes a metering slot 52, see FIGS. 2 and 4. The outer structure 30, the first internal partition 40 and the second internal partition 50 define an intermediate leg 62 of the cooling circuit 600. The intermediate leg 62 communicates with the entrance leg 60. The second internal partition 50 and the outer structure 30 define an exit leg 64 of the cooling circuit 600. The metering slot 52 meters the cooling fluid as it passes from the intermediate leg 62 into the exit leg 64. As illustrated in FIG. 4, the metering slot has a width $W_S$ which may be substantially less than a width $W_{IL}$ of the intermediate leg 62 of the cooling circuit 600, i.e., the metering slot width $W_S$ may be substantially less than the distance $W_{IL}$ extending between an inner surface 72A of a first wall 72 of an attachment 70 and an inner surface 74A of a second wall 74 of the attachment 70.

A plate 210 is coupled to a lower surface 70A of the attachment 70 to close off lower portions of the intermediate and exit legs 62 and 64 of the cooling circuit 600, see FIG. 2.

The outer structure 30 may define at least portions of the attachment 70, a platform 80 and an airfoil 90. The attachment 70 functions to couple the blade 10 to the shaft and disc assembly (not shown) in the gas turbine (not shown). The airfoil 90 comprises a root section 92, a tip 94, a leading edge 96, a trailing edge 98, a concave-shaped pressure side 100, and a convex-shaped suction side 102, see FIGS. 1, 2 and 5. In the illustrated embodiment, the attachment 70, the platform 80 and the airfoil 90 are formed as a single integral unit from a material such as a metal alloy 247 via a conventional casting operation. A conventional thermal barrier coating (not shown) is provided on an outer surface 30A of the outer structure 30.

The outer structure 30 may include an airfoil outer wall 120, the airfoil tip 94 and an intermediate wall 130. The airfoil outer wall 120 defines the root section 92, the leading edge 96, the trailing edge 98, the pressure side 100 and the suction side 102 of the airfoil 90. In the illustrated embodiment, the intermediate wall 130 extends from the airfoil root section 92 to the airfoil tip 94 and defines with a leading edge section 122 of the airfoil outer wall 120 an impingement cavity 140, see FIGS. 2 and 5. The intermediate wall 130 may include a plurality of bores 130A through which cooling fluid passes under pressure from the entrance leg 60 of the cooling circuit 600 into the impingement cavity 140 so as to impinge upon corresponding sections 222 of an inner surface 122A of the leading edge section 122 of the airfoil outer wall 120.

Figure 5:
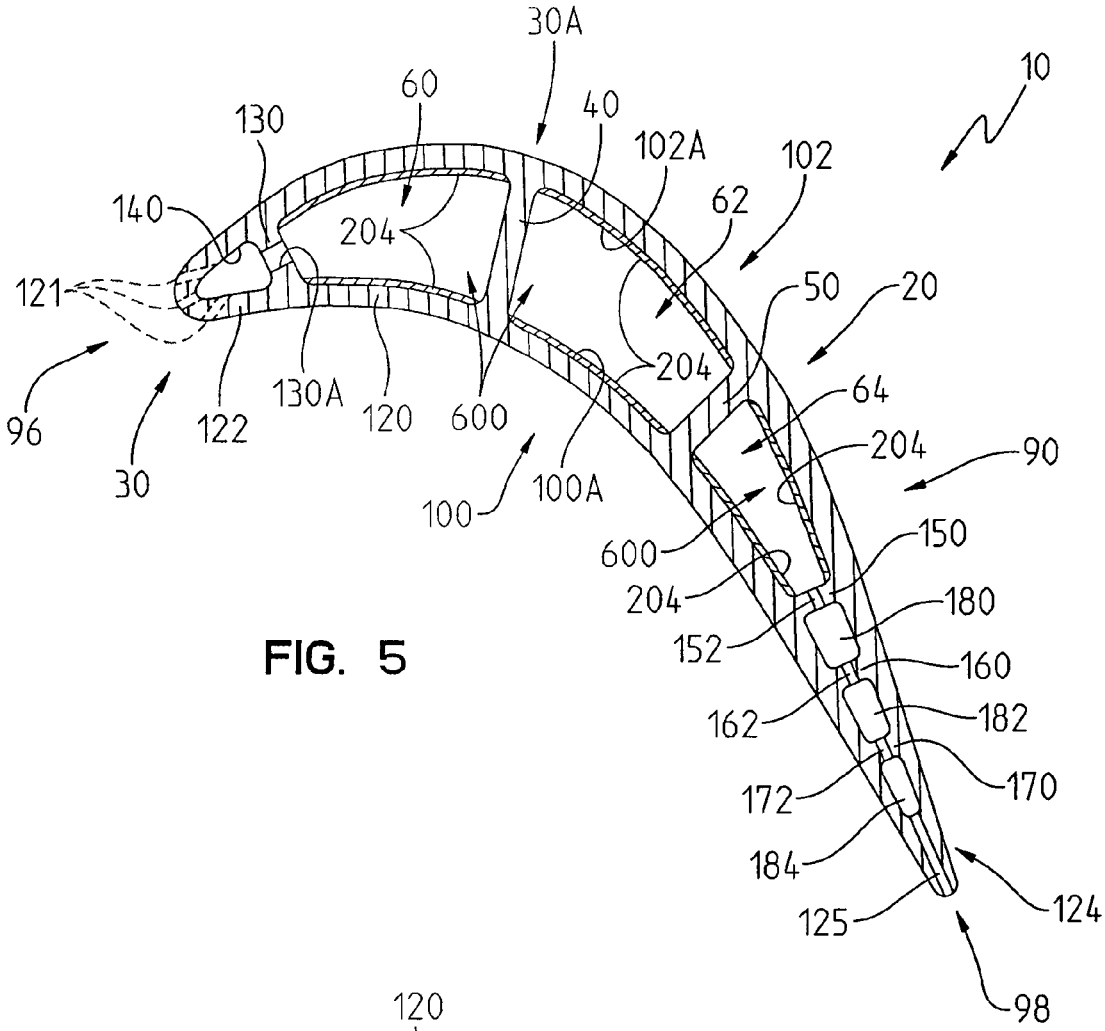
FIG. 5 is a view taken along section line 5-5 in FIG. 1.

The leading edge section 122 of the airfoil outer wall 120 may further comprise a plurality of bores 121 extending completely through the leading edge section 122, see FIGS. 1, 2 and 5. Cooling fluid passes from the impingement cavity 140 through the bores 121.

The first internal partition 40 may extend from the lower surface 70A of the attachment 70, through the attachment 70 and the platform 80, into and through a substantial length of the airfoil outer wall 120 and terminate near the airfoil tip 94, see FIG. 2.

The second internal partition 50 may extend from the airfoil tip 94, through the airfoil outer wall 120, the platform 80 and the attachment 70 and may terminate at the attachment lower surface 70A.

A trailing edge section 124 of the airfoil outer wall 120 may comprise a plurality of bores 125 which extend completely through the trailing edge section 124 of the airfoil outer wall 120.

A first rib plate 150 may be provided extending from near the root section 92 of the airfoil 90 to near the airfoil tip 94 and further extending between the pressure and suction sides 100 and 102 of the airfoil 90, see FIGS. 2, 3, 5 and 6. The first rib plate 150 may include a plurality of bores 152 extending therethrough.

A second rib plate 160 may also be provided extending from near the root section 92 of the airfoil 90 to near the airfoil tip 94 and further extending between the pressure and suction sides 100 and 102 of the airfoil 90, see FIGS. 2, 3, 5 and 6. The second rib plate 160 may include a plurality of bores 162 extending therethrough.

A third rib plate 170 may also be provided extending from near the root section 92 of the airfoil 90 to near the airfoil tip 94 and further extending between the pressure and suction sides 100 and 102 of the airfoil 90, see FIGS. 2, 3, 5 and 6. The third rib plate 170 may include a plurality of bores 172 extending therethrough.

Figure 3:
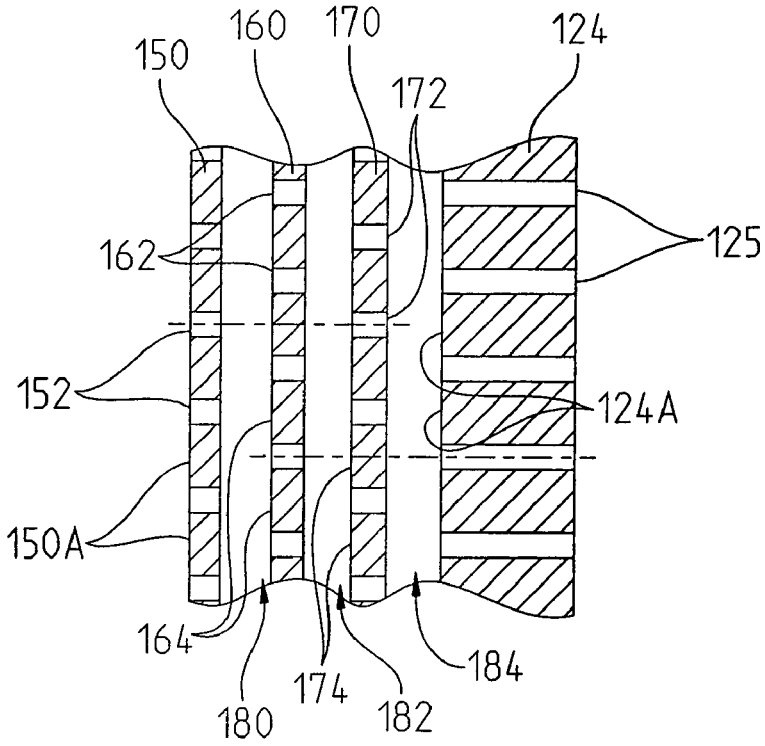
FIG. 3 is a sectional view of a portion of first, second and third rib plates and a trailing edge section of an airfoil outer wall.
Figure 6:
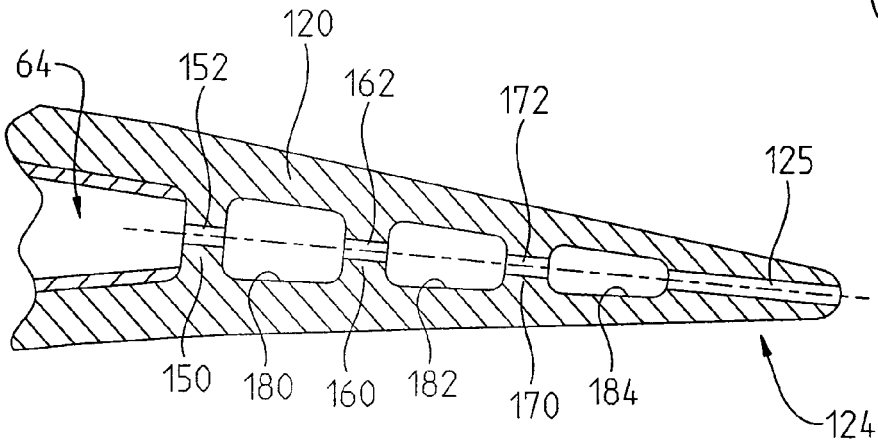
FIG. 6 is a cross sectional view taken through the first, second and third rib plates and the trailing edge section of the airfoil outer wall.

A first passage 180 is defined between the first and second rib plates 150 and 160; a second passage 182 is defined between the second and third rib plates 160 and 170; and a third passage 184 is defined between the third rib plate 170 and the trailing edge section 124 of the airfoil outer wall 120, see FIGS. 3, 5 and 6.

Cooling fluid under pressure in the exit leg 64 of the cooling circuit 600 passes through the plurality of bores 152 in the first rib plate 150 into the first passage 180 and impinges upon corresponding sections 164 of the second rib plate 160 so as to effect impingement cooling of those second rib plate sections 164, see FIGS. 2 and 3. Cooling fluid under pressure in the first passage 180 passes through the plurality of bores 162 in the second rib plate 160 into the second passage 182 and impinges upon corresponding sections 174 of the third rib plate 170 so as to effect impingement cooling of those third rib plate sections 174. Cooling fluid under pressure in the second passage 182 passes through the plurality of bores 172 in the third rib plate 170 into the third passage 184 and impinges upon corresponding portions 124A of the trailing edge section 124 of the airfoil outer wall 120 so as to effect impingement cooling of those trailing edge section portions 124A. Cooling fluid under pressure in the third passage 184 exits the third passage 184 through the bores 125 in the trailing edge section 124.

In the illustrated embodiment, the bores 152 in the first rib plate 150 are offset relative to the bores 162 in the second rib plate 160; the bores 162 in the second rib plate 160 are offset relative to the bores 172 in the third rib plate 170; and the bores 172 in the third rib plate 170 are offset relative to the bores 125 in the trailing edge section 124 of the airfoil outer wall 120.

As noted above, the metering slot 52 in the second internal partition 50 meters the cooling fluid as it passes from the intermediate leg 62 into the exit leg 64. As also noted above, the metering slot 52 has a width $W_S$ which may be substantially less than a width $W_{IL}$ extending between the inner surface 72A of the first wall 72 of the attachment 70 and the inner surface 74A of the second wall 74 of the attachment 70, see FIG. 4. Preferably, the width $W_S$ of the metering slot 52 is selected such that the pressure of the cooling fluid in the entrance and intermediate legs 60 and 62 of the cooling circuit 600 is substantially greater than a pressure of the cooling fluid in the exit leg 64 of the cooling circuit 600 during operation of the gas turbine engine. By providing a substantially lower cooling fluid pressure in the exit leg 64 of the cooling circuit 600, the diameters of the bores 152, 162, 172 and 125 in the first rib plate 150, the second rib plate 160, the third rib plate 170 and the trailing edge portion 124 can be formed larger than they otherwise could be formed if the pressure of the cooling fluid in the exit leg 64 of the cooling circuit 600 was only slightly less than the pressure of the cooling fluid in the entrance and intermediate legs 60 and 62 of the cooling circuit 600. Larger diameters for the bores 152, 162, 172 and 125 in the first rib plate 150, the second rib plate 160, the third rib plate 170 and the trailing edge portion 124 generally allow the blade 10 to be made more easily and at a lower cost.

Inner surfaces 100A and 102A of the pressure and suction sides 100 and 102 of the airfoil 90 defining the entrance, intermediate and exit legs 60, 62 and 64 of the cooling circuit 600 are provided with a plurality of trip strips 204 to increase turbulence of the flow of cooling fluid along the inner surfaces 100A and 102A so as to improve heat transfer from the pressure and suction sides 100 and 102 of the airfoil 90 to the cooling fluid, see FIGS. 2 and 5.

While a particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A blade for a gas turbine engine comprising:

a main body comprising:

an outer structure;

a first internal partition, said outer structure and said first internal partition defining an entrance leg of a cooling circuit for receiving a cooling fluid; and a second internal partition including a metering slot extending to a lowermost portion of said outer structure, said first internal partition being located nearer to a leading edge than said second internal partition;

wherein said outer structure, said first internal partition and said second internal partition defining an intermediate leg of said cooling circuit, said intermediate leg communicating with said entrance leg, and said second internal partition and said outer structure defining an exit leg of said cooling circuit that includes a substantial portion that is located adjacent to said intermediate leg, said metering slot formed between said intermediate leg and said exit leg and metering cooling fluid as it passes from said intermediate leg into said exit leg such that a pressure of the cooling fluid in said intermediate leg is greater than a pressure of the cooling fluid in said exit leg.

2. The blade as set out in claim 1, wherein said outer structure defines at least portions of an attachment, a platform and an airfoil, said airfoil comprising a root section, a tip, said leading edge, a trailing edge, a pressure side and a suction side.

3. The blade as set out in claim 2, wherein said outer structure comprises:

an airfoil outer wall defining said root section, said leading edge, said trailing edge, said pressure side and said suction side of said airfoil;

said airfoil tip; and an intermediate wall extending from said airfoil root section to said airfoil tip and defining with a leading edge section of said airfoil outer wall an impingement cavity, said intermediate wall including a plurality of bores through which cooling fluid passes under pressure from said entrance leg of said cooling circuit into said impingement cavity so as to impinge upon an inner surface of said leading edge section of said outer wall.

4. The blade as set out in claim 3, wherein said leading edge section of said airfoil outer wall comprises a plurality of bores which extend from said inner surface of said leading edge section to an outer surface of said leading edge section, said bores in said leading edge section communicate with said impingement cavity.

5. The blade as set out in claim 3, wherein said first internal partition extends from a lower surface of said attachment, through said attachment and said platform, into and through a substantial length of said airfoil outer wall and terminating near said airfoil tip.

6. The blade as set out in claim 5, wherein said second internal partition extends from said airfoil tip, through said airfoil outer wall, said platform and said attachment and terminates at said attachment lower surface.

7. The blade as set out in claim 3, wherein a trailing edge section of said airfoil outer wall comprises a plurality of bores which extend from an inner surface of said trailing edge section to an outer surface of said trailing edge section.

8. The blade as set out in claim 3, further comprising a first rib plate extending from near said root section of said airfoil to near said airfoil tip and further extending between said suction and pressure sides of said airfoil, said first rib plate including a plurality of bores extending therethrough.

9. The blade as set out in claim 8, further comprising a second rib plate extending from near said root section of said airfoil to near said airfoil tip and further extending between said suction and pressure sides of said airfoil, said second rib plate including a plurality of bores extending therethrough, wherein cooling fluid passing through said bores in said first rib plate impinge upon said second rib plate.

10. The blade as set out in claim 2, further comprising a plate structure for allowing the cooling fluid to effect a sequence of impingement cooling prior to passing through trailing edge section bores.

11. A blade for a gas turbine engine comprising:

a main body comprising:

an outer structure defining at least portions of an attachment;

a first internal partition, said outer structure and said first internal partition defining an entrance leg of a cooling circuit for receiving a cooling fluid; and a second internal partition including a metering slot having a radial length generally corresponding to a radial length of said attachment and extending to a lowermost portion of said outer structure, said first internal partition being located nearer to a leading edge than said second internal partition;

wherein said outer structure, said first internal partition and said second internal partition defining an intermediate leg of said cooling circuit, and said second internal partition and said outer structure defining an exit leg of said cooling circuit that includes a substantial portion that is located adjacent to said intermediate leg, said metering slot formed between said intermediate leg and said exit leg and defining a mechanism for causing a pressure of the cooling fluid in said entrance and intermediate legs to be greater than a pressure of the cooling fluid in said exit leg.

12. The blade as set out in claim 11, wherein said outer structure further defines at least portions of a platform and an airfoil, said airfoil comprising a root section, a tip, said leading edge, a trailing edge, a pressure side and a suction side, and said second internal partition extends from a lower surface of said attachment to said tip.

13. The blade as set out in claim 12, wherein said outer structure comprises:

an airfoil outer wall defining said root section, said leading edge, said trailing edge, said pressure side and said suction side of said airfoil;

said airfoil tip; and an intermediate wall extending from said airfoil root section to said airfoil tip and defining with a leading edge section of said airfoil outer wall an impingement cavity, said intermediate wall including a plurality of bores through which cooling fluid passes under pressure from said entrance leg of said cooling circuit into said impingement cavity so as to impinge upon an inner surface of said leading edge section of said outer wall.

14. The blade as set out in claim 13, wherein said leading edge section of said airfoil outer wall comprises a plurality of bores which extend from said inner surface of said leading edge section to an outer surface of said leading edge section, said bores in said leading edge section communicate with said impingement cavity.

15. The blade as set out in claim 13, wherein said first internal partition extends from said lower surface of said attachment, through said attachment and said platform, into and through a substantial length of said airfoil outer wall and terminating near said airfoil tip.

16. The blade as set out in claim 15, wherein said second internal partition extends from said airfoil tip, through said airfoil outer wall, said platform and said attachment and terminates at said attachment lower surface.

17. The blade as set out in claim 13, wherein a trailing edge section of said airfoil outer wall comprises a plurality of bores which extend from an inner surface of said trailing edge section to an outer surface of said trailing edge section.

18. The blade as set out in claim 12, further comprising a plate structure for allowing the cooling fluid to effect a sequence of impingement cooling prior to passing through trailing edge section bores.

19. A main body for a gas turbine engine comprising:

an outer structure defining at least portions of an attachment;

a first internal partition, said outer structure and said first internal partition defining an entrance leg of a cooling circuit for receiving a cooling fluid; and a second internal partition including a metering slot extending through at least a substantial portion of said attachment and including a radially innermost portion near a radially innermost portion of said attachment, said first internal partition being located nearer to a leading edge than said second internal partition;

wherein said outer structure, said first internal partition and said second internal partition defining an intermediate leg of said cooling circuit, said intermediate leg communicating with said entrance leg, and said second internal partition and said outer structure defining an exit leg of said cooling circuit that includes a substantial portion that is located adjacent to said intermediate leg, said metering slot formed between said intermediate leg and said exit leg extending to a lowermost portion of said outer structure, and metering cooling fluid as it passes from said intermediate leg into said exit leg such that the cooling fluid after passing into said exit leg effects a sequence of impingement cooling in a plate structure prior to passing through an airfoil trailing edge section of said outer structure.

20. The main body as set out in claim 19, wherein said outer structure further defines at least portions of an airfoil comprising said leading edge, said trailing edge, a pressure side and a suction side.

* * * * *